US009075356B2

(12) United States Patent
Ooyanagi

(10) Patent No.: US 9,075,356 B2
(45) Date of Patent: Jul. 7, 2015

(54) IMAGE FORMING APPARATUS AND IMAGE FORMING METHOD

(71) Applicant: CANON KABUSHIKI KAISHA, Tokyo (JP)

(72) Inventor: Maho Ooyanagi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 14/017,759

(22) Filed: Sep. 4, 2013

(65) Prior Publication Data

US 2014/0072321 A1 Mar. 13, 2014

(30) Foreign Application Priority Data

Sep. 13, 2012 (JP) ..... 2012-201526
Aug. 9, 2013 (JP) ..... 2013-166513

(51) Int. Cl.
*G03G 15/20* (2006.01)
*G03G 13/20* (2006.01)
*G03G 15/00* (2006.01)

(52) U.S. Cl.
CPC ..... *G03G 15/2039* (2013.01); *G03G 13/20* (2013.01); *G03G 15/5025* (2013.01)

(58) Field of Classification Search
USPC ..... 399/67, 69, 336
See application file for complete search history.

(56) References Cited

U.S. PATENT DOCUMENTS

2012/0114359 A1* 5/2012 Yura et al. ..... 399/70

FOREIGN PATENT DOCUMENTS

JP 2000-221831 A 8/2000

* cited by examiner

*Primary Examiner* — David Gray
*Assistant Examiner* — Michael Harrison
(74) *Attorney, Agent, or Firm* — Cowan, Liebowitz & Latman, P.C.

(57) ABSTRACT

In an image forming apparatus having a fixing unit for fixing a toner image on a printing medium, it is necessary to control a fixing temperature with high precision according to the content of an image. An image forming apparatus of the present invention includes: an input unit configured to input image data; and a controlling unit configured to control the fixing temperature of the fixing unit based on a size of a continuous region of pixels whose pixel values are equal to or larger than a predetermined pixel value in the image data.

6 Claims, 13 Drawing Sheets

| VALUE OF REGION INFORMATION | TEMPERATURE FOR CONTROLLING FIXING |
|---|---|
| 3600 OR MORE PIXELS | 200.000°C |
| 3599 PIXELS | 199.995°C |
| 3598 PIXELS | 199.990°C |
| • | • |
| • | • |
| • | • |
| 2500 PIXELS | 195.000°C |
| • | • |
| • | • |
| • | • |
| 1 PIXEL | 180.000°C |

FIG.9

IMAGE FORMING APPARATUS AND IMAGE FORMING METHOD

BACKGROUND OF THE INVENTION

1. Field of the Invention

The present invention relates to an image forming apparatus, an image forming method and program for controlling temperature of a fixing unit in fixing a formed toner image on a printing medium.

2. Description of the Related Art

In an image forming apparatus for fixing a toner image formed by electrophotography on a printing medium such as transfer paper, it is necessary to control a fixing temperature in order to reliably fix the toner image. As methods for determining a fixing temperature, various techniques already exist. For example, there is a method in which in order to reliably fixing an image whose amount of toner applied on transfer paper is large, the characteristics of an image (a character, a graph, and a high-density portion having a large area) are identified based on a distribution ratio of an image area value for each image density, and a fixing temperature for fixing an image is determined according to the characteristics of the image (see Japanese Patent Laid-open No. 2000-221831).

In Japanese Patent Laid-open No. 2000-221831, the fixing temperature is controlled according to the distribution ratio of the image area value for each image density, but the continuity of pixels having a predetermined density is not determined. Accordingly, it is impossible to determine whether pixels having a high density are positioned in an image discretely or in a concentrated manner.

In a case where the fixing temperature of a fixing device is determined according to the distribution ratio of the image area value as disclosed in Japanese Patent Laid-open No. 2000-221831, the fixing temperature may fail to be controlled with high precision for the image. A specific explanation thereof will be given below.

A temperature at which an image is fixed is determined according to heat efficiency for the contact area of a transfer sheet at the time of passing through a nip portion of the fixing device. Accordingly, in a case where the fixing temperature of the fixing device is determined according to the distribution ratio of the image area value as disclosed in Japanese Patent Laid-open No. 2000-221831, the image may be fixed at a temperature which is higher or lower than an anticipated temperature. More specifically, in a case where in the image, pixels whose amount of applied toner is equal to or larger than a predetermined threshold are distributed as a large number of portions whose area is smaller than the area of contact between the nip portion of the fixing device and the transfer sheet (i.e., in a case where pixels having a high density are distributed discretely), the image is fixed at a temperature which is higher than the anticipated temperature. Further, conversely, in a case where in the image, pixels whose amount of applied toner is equal to or larger than a predetermined threshold are distributed as a small number of portions whose area is larger than the area of contact between the nip portion of the fixing device and the transfer sheet (i.e., in a case where pixels having a high density are distributed in a concentrated manner), the image is fixed at a temperature which is lower than the anticipated temperature. This causes curling of the transfer sheet which is due to high-temperature control, a failure to fix the image which is due to low-temperature control, or the like.

SUMMARY OF THE INVENTION

An image forming apparatus of the present invention is an image forming apparatus for controlling a fixing temperature of a fixing unit configured to fix color material on a printing medium, the image forming apparatus comprising: an input unit configured to input image data; and a controlling unit configured to control a fixing temperature of the fixing unit based on area of a continuous region of pixels whose pixel values are equal to or larger than a predetermined pixel value in the image data.

According to the present invention, the area of the continuous regions of the pixels whose amount of applied toner is equal to or larger than the predetermined threshold is used to control the fixing temperature of the fixing unit, whereby the fixing temperature can be controlled with higher precision according to the content of the image.

Further features of the present invention will become apparent from the following description of exemplary embodiments (with reference to the attached drawings).

BRIEF DESCRIPTION OF THE DRAWINGS

FIG. 9 shows a relationship between a fixing temperature and maximum area of continuous regions of pixels whose amount of applied toner is equal to or larger than a predetermined threshold in accordance with an embodiment;

DESCRIPTION OF THE EMBODIMENTS

In the following, embodiments of the present invention will be explained with reference to the drawings. Further, processing which will be explained below is performed by a CPU of an image forming apparatus according to a program stored in a ROM of the image forming apparatus.

(Embodiment 1)

Figure 1:
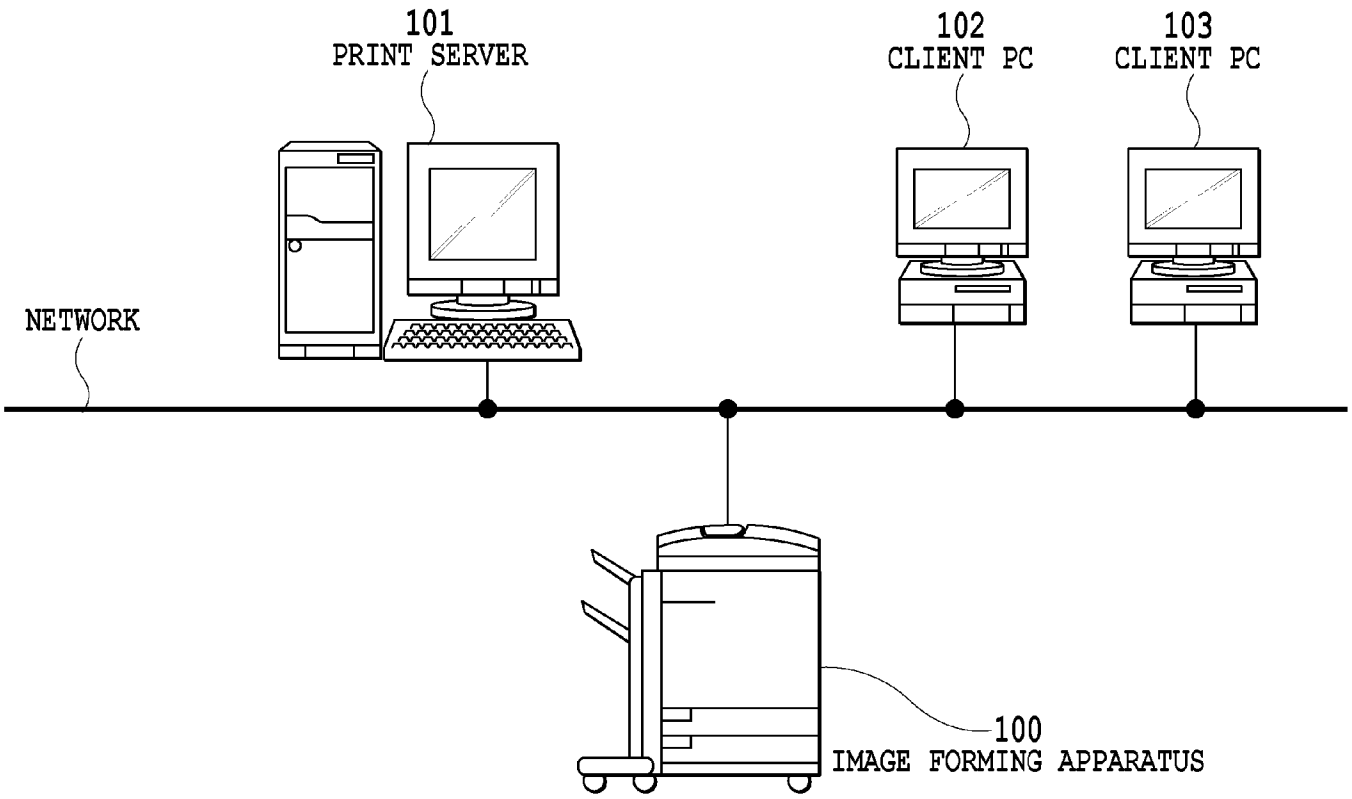
FIG. 1 shows the configuration of a network system including an image forming apparatus in accordance with an embodiment.

FIG. 1 shows an example of the configuration of a network system including an image forming apparatus in accordance with an embodiment of the present invention. An image forming apparatus 100 processes various types of input data, forms an image (creates an image), and outputs printed material. Further, as shown in FIG. 1, the image forming apparatus 100 is connected to a print server 101 and client PCs 102 and 103 via a network.

Figure 2:
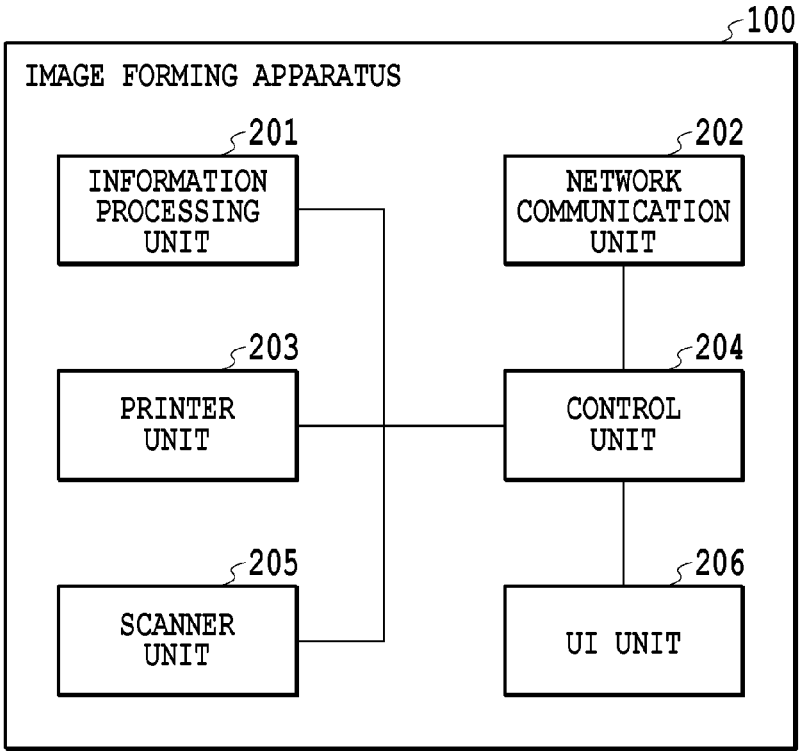
FIG. 2 shows the functional configuration of the image forming apparatus in accordance with the embodiment.

FIG. 2 shows the functional configuration of the image forming apparatus in accordance with the embodiment. As shown in FIG. 2, the image forming apparatus 100 includes an information processing unit 201, a network communication unit 202, a printer unit 203, a control unit 204, a scanner unit 205, and a UI unit 206.

The control unit 204 controls information processing by the information processing unit 201, print processing by the printer unit 203, and scan processing by the scanner unit 205. The information processing unit 201 generates information such as a YMCK signal to be used by the printer unit 203 based on image data received from the print server 101 or the client PCs 102 and 103 via the network communication unit 202. Otherwise, the information processing unit 201 can generate information such as a YMCK signal based on image data read by the scanner unit 205. Further, as described above, the control unit 204 and the information processing unit 201 are realized by the CPU of the image forming apparatus performing processing according to the program stored in the ROM of the image forming apparatus.

Figure 3:
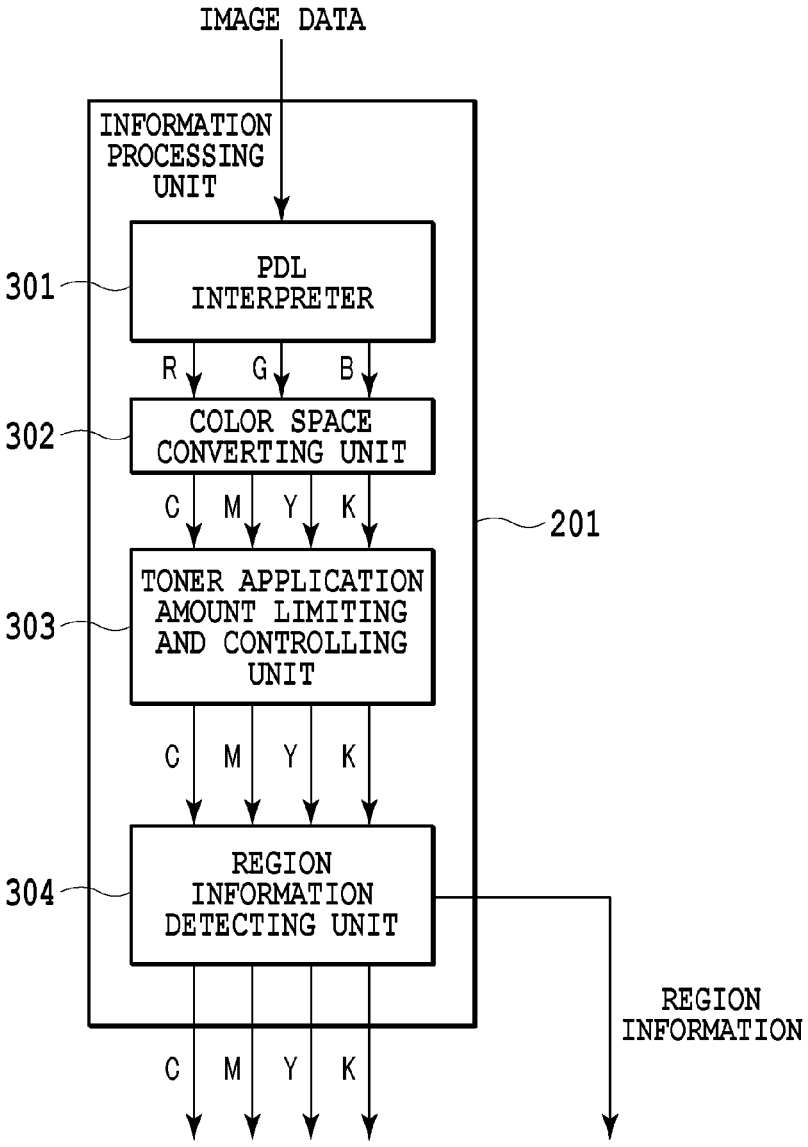
FIG. 3 shows the functional configuration of an information processing unit 201 of the image forming apparatus in accordance with the embodiment.

FIG. 3 shows the functional configuration of the information processing unit 201. As shown in FIG. 3, the information processing unit 201 includes a page description language (PDL) interpreter 301, a color space converting unit 302, a toner application amount limiting and controlling unit 303, and a region information detecting unit 304.

The PDL interpreter 301 analyzes image data sent from the client PCs. The color space converting unit 302 converts, into a YMCK signal, an RGB signal for the image data analyzed by the PDL interpreter 301. The toner application amount limiting and controlling unit 303 limits the amount of applied toner for the YMCK signal converted by the color space converting unit 302. The region information detecting unit 304 detects, as region information, maximum area of continuous regions of pixels whose amount of applied toner is equal to or larger than a predetermined threshold in an image constituted by the YMCK signal for which the amount of applied toner is limited by the toner application amount limiting and controlling unit 303. In the present embodiment, the predetermined threshold is 200% which is the maximum amount of applied toner, but the present invention is not limited to the predetermined threshold of 200%. As necessary, the predetermined threshold can be set to be equal to or smaller than the maximum amount of applied toner.

The YMCK signal for which the amount of applied toner is limited by the toner application amount limiting and controlling unit 303 and the region information detected by the region information detecting unit 304 are sent to the printer unit 203. The sent region information is used to control the temperature of a fixing unit 405 which will be explained below with reference to FIG. 4.

Figure 4:
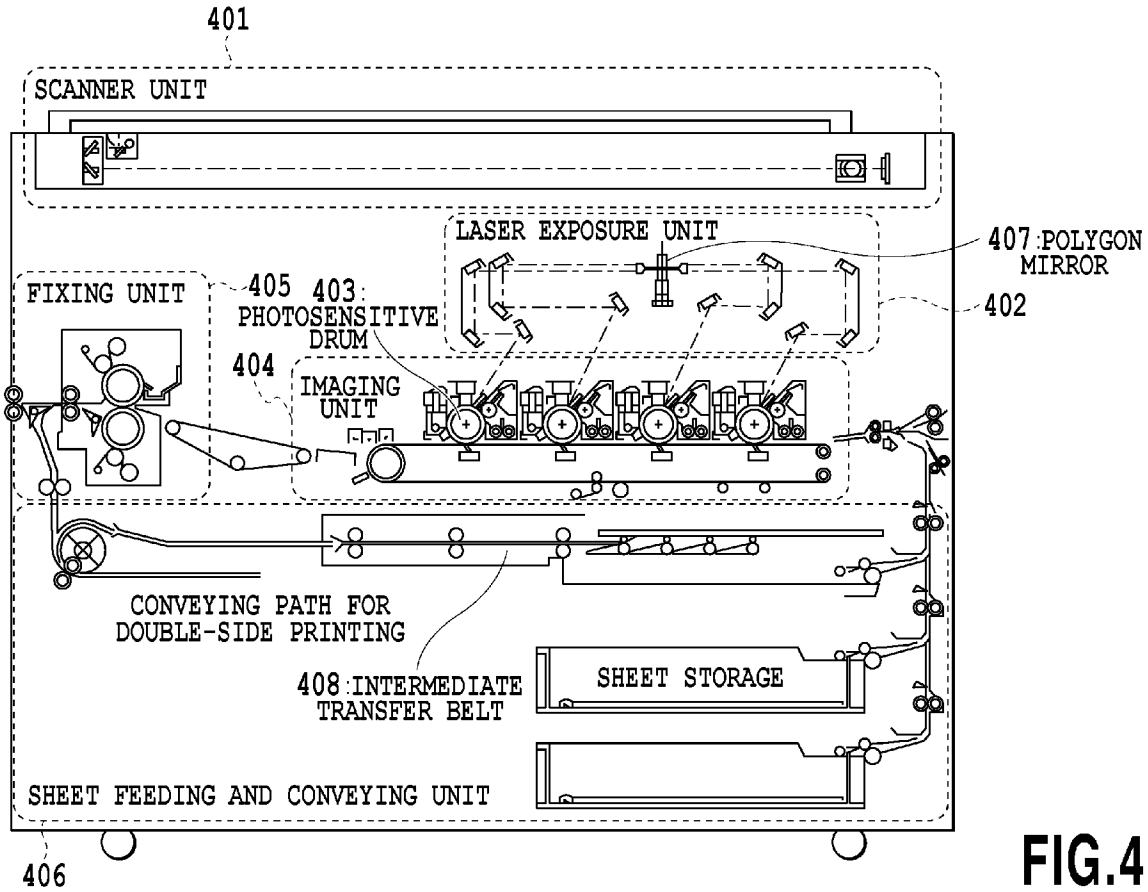
FIG. 4 shows the physical configuration of the image forming apparatus in accordance with the embodiment.

FIG. 4 shows the physical configurations of the scanner unit and the printer unit of the image forming apparatus 100.

The physical configuration of the scanner unit is shown in a portion of FIG. 4 which is indicated by "SCANNER UNIT" and "401." The scanner unit 401 illuminates a document placed on a platen to optically read an image of the document and converts the image into an electrical signal to create image data.

The physical configuration of the printer unit includes a laser exposure unit 402, photosensitive drums 403, an imaging unit 404, the fixing unit 405, a sheet feeding and conveying unit 406, a rotary polygon mirror 407, an intermediate transfer belt 408, and the like.

The laser exposure unit 402 causes a light beam such as laser light modulated according to image data to be incident on the rotary polygon mirror 407 which rotates at a constant angular velocity and illuminates the photosensitive drums 403 with reflected scan light.

The imaging unit 404 is realized by providing four image development units (image development stations) for a series of electrophotographic processes. Each image development unit rotates its photosensitive drum 403, electrically charges the photosensitive drum 403 by using a charger, and develops, with toner, a latent image formed on the photosensitive drum 403 by the laser exposure unit 402. The toner image is transferred to a printing medium (a sheet or the like) through the intermediate transfer belt 408. Further, a trace amount of toner which is not transferred and remains on the photosensitive drum 403 is collected by the image development unit.

The four image development units are arranged in the order of yellow (Y), magenta (M), cyan (C), and black (K). After a predetermined period has passed since a yellow station starts to form an image, magenta, cyan, and black imaging operations are sequentially performed. This timing control enables a full-color toner image to be transferred to a sheet without any color shift. This embodiment is directed to a color printer, but the present invention is not limited to the color printer. In the case of a black-and-white printer, only a black image development unit is mounted.

The fixing unit 405 includes a combination of rollers and a belt and contains a heat source such as a halogen heater to melt and fix, with heat and pressure, toner on a sheet to which a toner image is transferred by the imaging unit 404. Further, a fixing temperature is controlled according to region information.

The sheet feeding and conveying unit 406 includes one or more sheet storages such as a sheet cassette or a paper deck. One sheet is separated from a plurality of sheets stored in a sheet storage and conveyed to the imaging unit and the fixing unit. The sheet is conveyed and the above-described image development stations transfer respective color toner images and eventually a full-color toner image is formed on the sheet. Further, in order to form an image on both sides of the sheet, control is performed so that the sheet having passed through the fixing unit passes through a conveying path for conveyance to the imaging unit 404 again.

Further, the control unit 204 explained with reference to FIG. 2 communicates with the printer unit 203 and the scanner unit 205 and provides instructions so as to manage the states of the scanner unit, the laser exposure unit, the imaging unit, the fixing unit, and the sheet feeding and conveying unit so that these units as a whole operate harmoniously and smoothly.

Figure 5A:
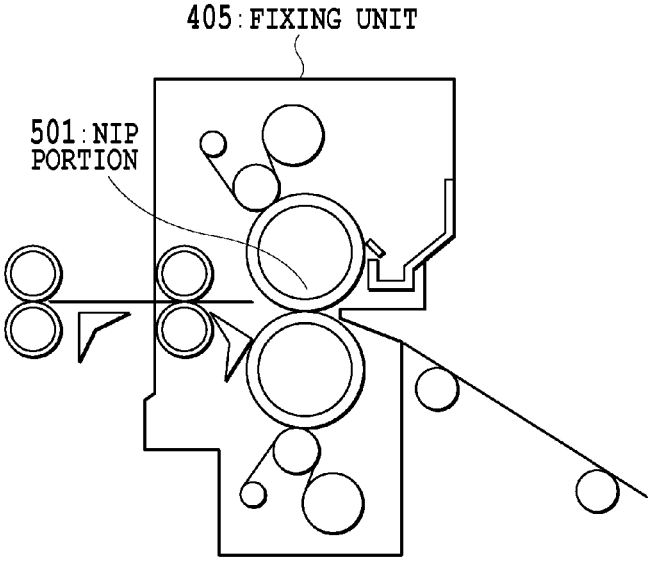
FIG. 5A is a cross-sectional view of a fixing unit in accordance with the embodiment.
Figure 5B:
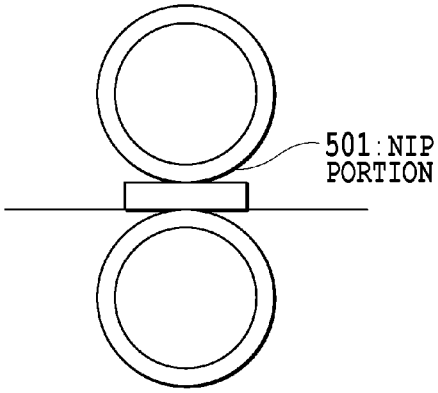
FIG. 5B is a cross-sectional view of a nip portion at the time of fixing in accordance with the embodiment.
Figure 5C:
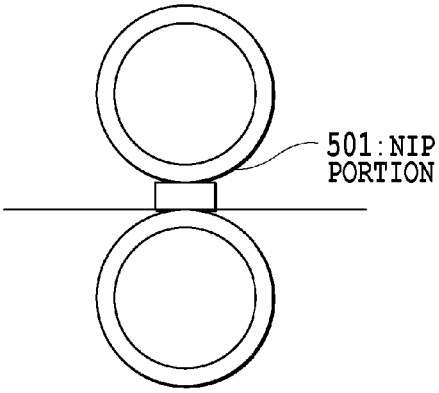
FIG. 5C is a cross-sectional view of the nip portion at the time of fixing in accordance with the embodiment.

FIG. 5A is an enlarged view of the fixing unit 405. FIGS. 5B and 5C show a contact state of a nip portion 501 at the time when a transfer sheet passes through the nip portion 501. Depending on an image, there is a case where the area of the pixels which are in contact with the nip portion 501 and which have the maximum amount of applied toner is large as shown in FIG. 5B, and there is also a case where the area of the pixels which are in contact with the nip portion 501 and which have the maximum amount of applied toner is small as shown in FIG. 5C.

In the case where the area of the pixels which are in contact with the nip portion 501 and which have the maximum amount of applied toner is large as shown in FIG. 5B, a higher fixing temperature is necessary as compared with the case where the area of the pixels which are in contact with the nip portion 501 and which have the maximum amount of applied toner is small as shown in FIG. 5C. Further, in a case where the area of the pixels which are in contact with the nip portion 501 and which have the maximum amount of applied toner exceeds a certain level, there is no choice but to control fixing at high temperatures. However, in a case where the area of the pixels which are in contact with the nip portion 501 and which have the maximum amount of applied toner is small, it is possible to control fixing at low temperatures. This is because in the case where the area of the pixels which are in contact with the nip portion 501 and which have the maximum amount of applied toner is small, heat from a portion having no applied toner in a sheet is transferred to a portion having applied toner at the time of fixing, and it is possible to fix the image at low fixing temperatures. In the case where the area of the pixels which are in contact with the nip portion 501 and which have the maximum amount of applied toner exceeds a certain level, heat from a portion having no applied toner in a sheet is not transferred close to a center of a portion having applied toner, and therefore it is necessary to control fixing at high fixing temperatures.

Accordingly, in the present embodiment, the region information detecting unit 304 detects the area of the pixels which are in an image and whose amount of applied toner is equal to or larger than the predetermined threshold and controls the fixing unit 405 according to the detection result.

Figure 6:
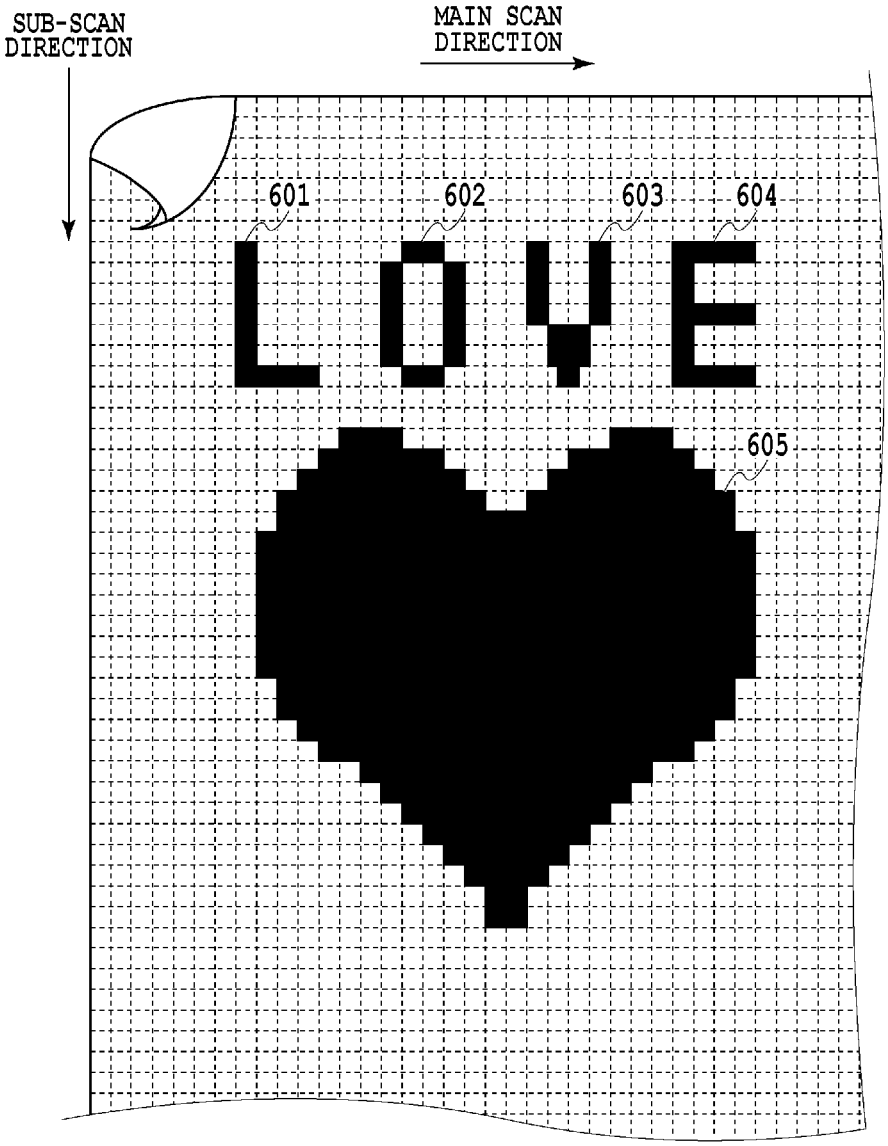
FIG. 6 shows a detected region in an image in accordance with the embodiment.

FIG. 6 shows part of an output image. Regions 601 to 605 are regions of pixels which have a maximum amount of applied toner. Further, the region 601 is composed of 10 pixels, the region 602 is composed of 14 pixels, the region 603 is composed of 13 pixels, the region 604 is composed of 19 pixels, the region 605 is composed of 426 pixels, and these regions exist in one page. In the present embodiment, the region information detecting unit 304 detects the areas of the pixels of the regions 601 to 605 and controls the temperature of the fixing unit 405 according to the detection result.

Figure 7:
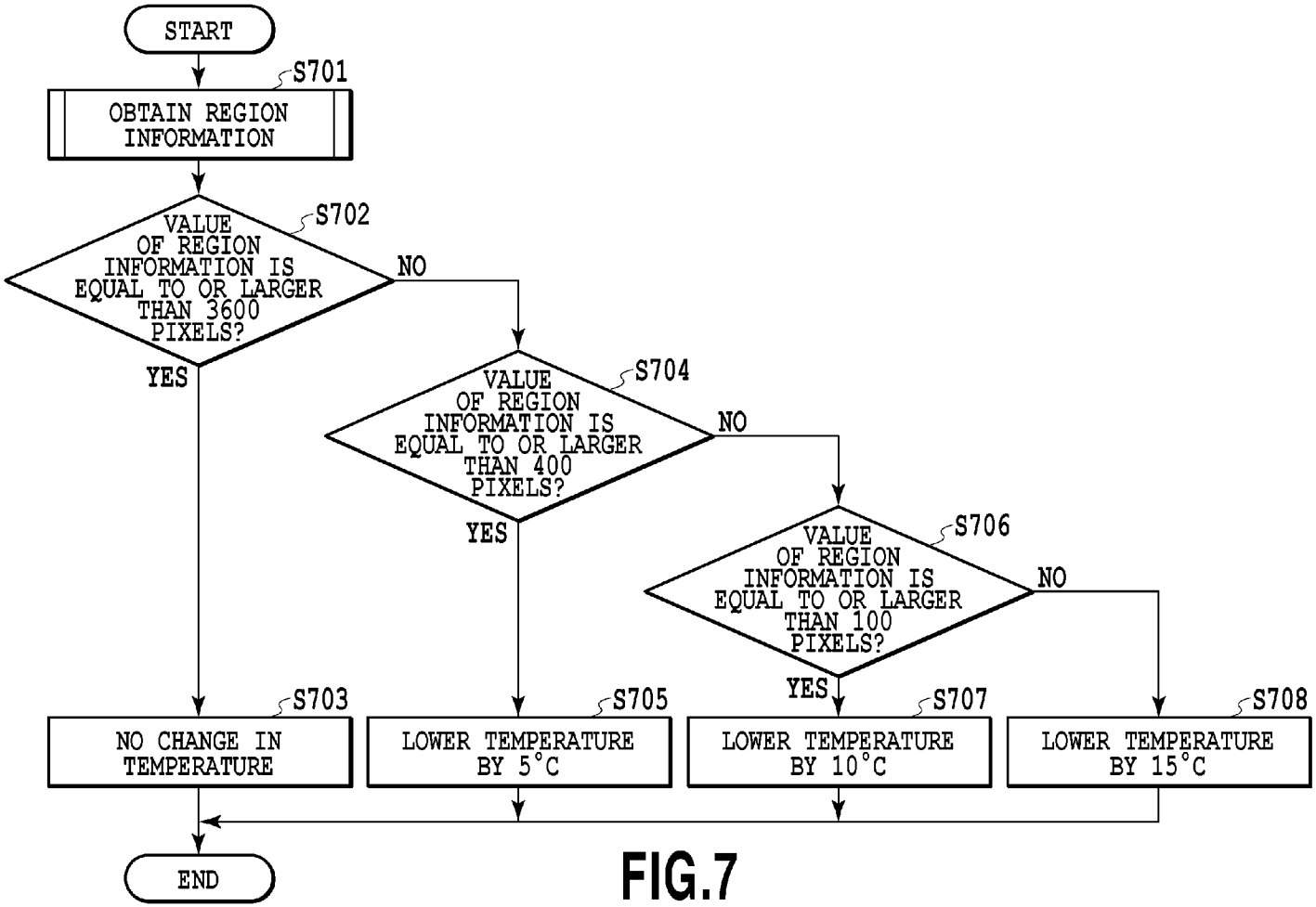
FIG. 7 is a flowchart of fixing temperature control performed by the image forming apparatus in accordance with the embodiment.

FIG. 7 is a flowchart for a case where the control unit 204 controls the temperature of the fixing unit 305 according to the result of detection by the region information detecting unit 304. More specifically, in the present embodiment, the result of detection by the region information detecting unit 304 is maximum area of continuous regions of pixels whose amount of applied toner (pixel value) is equal to or larger than the predetermined threshold. Further, this flowchart is implemented by the CPU of the image forming apparatus 100 performing processing according to the program stored in the ROM of the image forming apparatus 100.

In step S701, the control unit 204 of the image forming apparatus 100 obtains the result of detection by the region information detecting unit 304 of the information processing unit 201. The details will be described later with reference to FIG. 8.

In step S702, the control unit 204 determines whether or not the value of the region information obtained in step S701 is equal to or larger than 3600 pixels. In a case where the value of the region information is equal to or larger than 3600 pixels, it is determined that the area of the pixels whose amount of applied toner is equal to or larger than the predetermined threshold exceeds a certain level as described above, and the process proceeds to step S703. Further, in a case where it is determined that the value of the region information is smaller than 3600 pixels, the process proceeds to step S704.

In step S703, the control unit 204 controls the temperature of the fixing unit 405 not to change the temperature at the time of fixing.

In step S704, the control unit 204 determines whether or not the value of the region information is equal to or larger than 400 pixels. In a case where the value of the region information is equal to or larger than 400 pixels, the process proceeds to step S705. In a case where the value of the region information is smaller than 400 pixels, the process proceeds to step S706.

In step S705, the control unit 204 controls the temperature of the fixing unit 405 to lower the temperature at the time of fixing by 5° C.

In step S706, the control unit 204 determines whether or not the value of the region information is equal to or larger than 100 pixels. In a case where it is determined that the value of the region information is equal to or larger than 100 pixels, the process proceeds to step S707. In a case where it is determined that the value of the region information is smaller than 100 pixels, the process proceeds to step S708.

In step S707, the control unit 204 controls the temperature of the fixing unit 405 to lower the temperature at the time of fixing by 10° C.

In step S708, the control unit 204 controls the temperature of the fixing unit 405 to lower the temperature at the time of fixing by 15° C.

As described above, the control unit 204 of the image forming apparatus 100 controls the temperature of the fixing unit 405 according to the value of the region information detected by the region information detecting unit 304.

Figure 8:
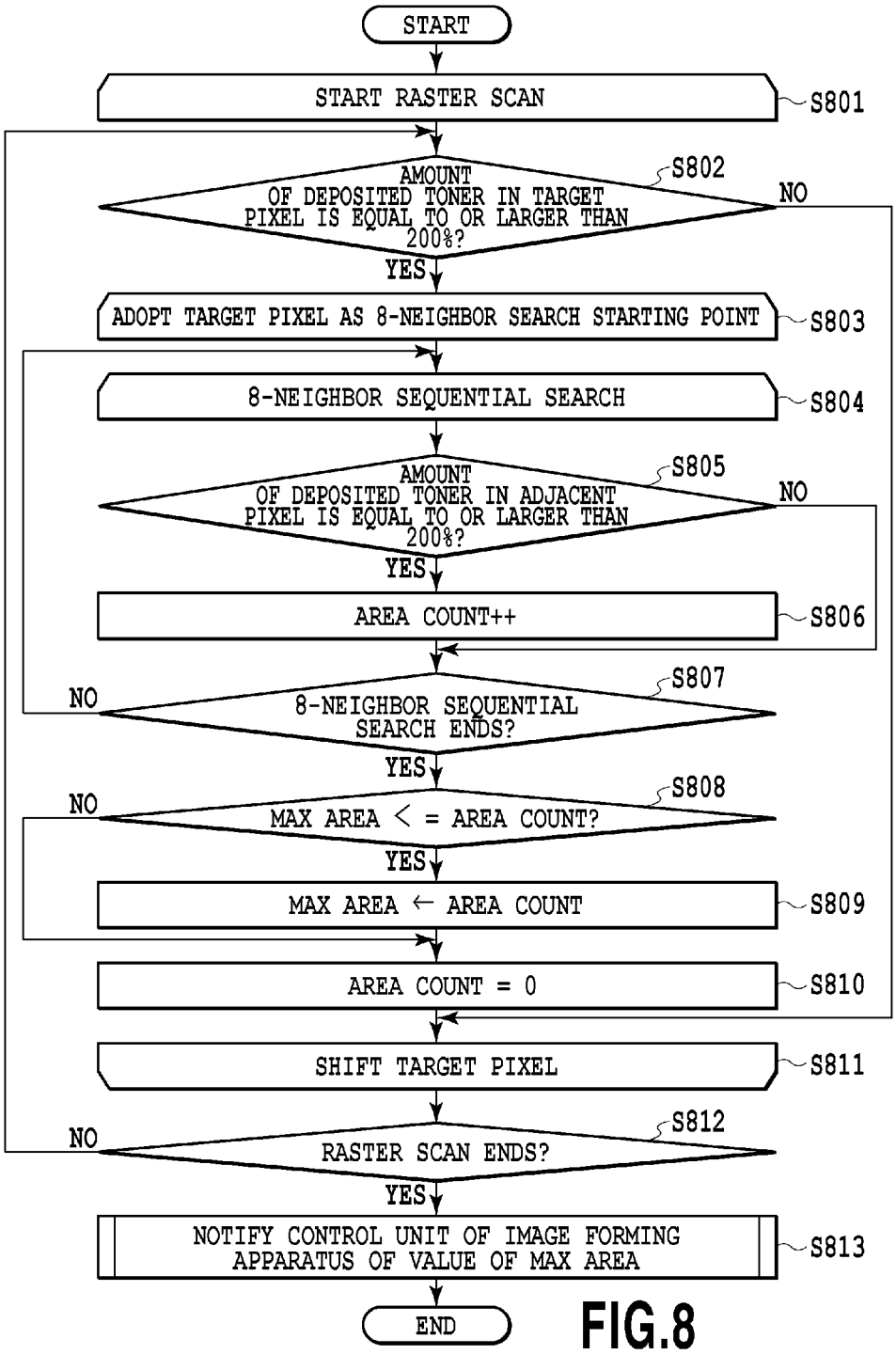
FIG. 8 is a flowchart of region information detection performed by a region information detecting unit in accordance with the embodiment.

Next, an explanation will be made on a method for detecting, by the region information detecting unit 304 of the information processing unit 201, maximum area of the continuous regions of the pixels whose amount of applied toner is equal to or larger than the predetermined threshold. FIG. 8 is a flowchart for detecting maximum area of the continuous regions of the pixels whose amount of applied toner is equal to or larger than the predetermined threshold. Further, this flowchart is implemented by the CPU of the image forming apparatus 100 performing processing according to the program stored in the ROM of the image forming apparatus 100.

In step S801, the region information detecting unit 304 of the information processing unit 201 starts raster scan.

In step S802, the region information detecting unit 304 determines whether or not the amount of applied toner of a targeted pixel (hereinafter referred to as "the target pixel") is equal to or larger than the predetermined threshold. In the present embodiment, the predetermined threshold is 200% which is the maximum amount of applied toner. In a case where it is determined that the amount of applied toner of the target pixel is equal to or larger than 200%, the process proceeds to step S803.

In step S803, the region information detecting unit 304 adopts the target pixel as an 8-neighbor search starting point.

In step S804, the region information detecting unit 304 starts 8-neighbor sequential search.

In step S805, the region information detecting unit 304 determines whether or not the amount of applied toner of an adjacent pixel is equal to or larger than 200%. In a case where it is determined that the amount of applied toner of the adjacent pixel is equal to or larger than 200%, the process proceeds to step S806.

In step S806, the region information detecting unit 304 increments the value of "Area Count" to calculate the area of the pixels whose amount of applied toner is equal to or larger than 200%.

In step S807, the region information detecting unit 304 determines whether the 8-neighbor sequential search ends. In a case where the process returns to the 8-neighbor search starting point, it is determined that the 8-neighbor sequential search ends, which indicates calculation on the area of the continuous region is completed. In a case where it is determined that the 8-neighbor sequential search ends, the process proceeds to step S808. Further, in a case where it is determined that the 8-neighbor sequential search does not end, the process proceeds to step 804.

In step S808, the region information detecting unit 304 compares the value of "Max Area" with the value of "Area Count" of the continuous region calculated in step S806. In a case where the value of "Area Count" calculated in step S806 is larger than the value of "Max Area," the process proceeds to step S809. Further, in a case where the value of "Area Count" calculated in step S806 is smaller than the value of "Max Area," the process proceeds to step S810.

In step S809, the region information detecting unit 304 assigns the value of "Area Count" to the value of "Max Area." In this manner, maximum area of the continuous regions is held as the value of "Max Area." More specifically, in a case where the areas of the pixels of the regions 601 and 602 in FIG. 6 are compared, it is determined that the area of the pixels of the region 602 is larger than the area of the pixels of the region 601, and the value of "Area Count" of the region 602 is held as the value of "Max Area."

In step S810, the region information detecting unit 304 clears the value of "Area Count."

In step S811, the region information detecting unit 304 shifts the target pixel.

In step S812, the region information detecting unit 304 determines whether raster scan ends. In a case where it is determined that raster scan does not end, the process proceeds to step S802. More specifically, steps S802 to S811 are repeated until it is determined that raster scan ends in step S812. Further, in a case where it is determined that raster scan ends, the process proceeds to step S813.

In step S813, the region information detecting unit 304 notifies the control unit 204 of the image forming apparatus 100 of the value of "Max Area" as the value of the region information.

As described above, the region information detecting unit 304 detects maximum area of the continuous regions of the pixels whose amount of applied toner is equal to or larger than the predetermined threshold. In the case of the image shown in FIG. 6, for example, the value of the region information detected by the region information detecting unit 304 is 426 pixels for the image 605, and the region information detecting unit 304 notifies the control unit 204 of the image forming apparatus 100 of this value.

The control unit 204 notified of the region information controls the temperature of the fixing unit 405 according to the region information as shown in the flowchart of FIG. 7. In the case of the image shown in FIG. 6, it is possible to lower the temperature at the time of fixing by 5° C. More specifically, assuming that the temperature of the fixing unit 405 is initially controlled at 180° C., it is possible to perform control so that the temperature of the fixing unit 405 at the time of fixing is 175° C. which is 5° C. lower.

As described above, in the present embodiment, maximum area of the continuous regions of the pixels whose amount of applied toner is largest is detected, and the temperature of the fixing unit 405 is controlled (the fixing temperature is determined) according to the detection result, whereby the fixing temperature can be controlled according to the thermal responsiveness of the fixing unit 405. Accordingly, the fixing temperature can be controlled with higher precision as compared with the case of identifying the characteristics of an entire image based on a relationship between a pixel density distribution ratio and the area of an image and determining a fixing temperature according to the characteristics.

Further, although the continuous regions of the pixels whose amount of applied toner is largest are detected in the present embodiment, it is possible to detect continuous regions of pixels whose amount of applied toner is not largest but second largest or third largest. Then the temperature of the fixing unit 405 is controlled according to the size of the detected continuous regions.

Further, in the present embodiment four-level conditions on the area of a continuous region of pixels whose amount of applied toner is equal to or larger than the threshold (i.e., the condition that the area is equal to or larger than 3600 pixels, the condition that the area is equal to or larger than 400 pixels and is smaller than 3600 pixels, the condition that the area is equal to or larger than 100 pixels and is smaller than 400 pixels, and the condition that the area is smaller than 100 pixels) are set to determine the temperature of the fixing unit 405. However, this is an example, and the present invention is not limited to this example. The conditions on the area (the conditions on the size) of a continuous region are determined according to a material used by the fixing unit 405 of the image forming apparatus 100 and the thermal responsiveness of the fixing unit 405. In this regard, the conditions on the area are not limited to four levels, and two or more levels may be set as necessary.

(Embodiment 2)

In Embodiment 1, the temperature of the fixing unit 405 is controlled discretely according to the result of detection by the region information detecting unit 304. More specifically, in Embodiment 1 four-level conditions on the area of a continuous region of pixels whose amount of applied toner is largest are set to determine the temperature of the fixing unit 405. In the present embodiment, the fixing temperatures of the fixing unit 405 are set discretely against conditions on the area of a continuous region of pixels whose amount of applied toner is equal to or larger than the predetermined threshold in order to determine the temperature of the fixing unit 405, but the temperature of the fixing unit 405 is determined continuously to perform temperature control. More specifically, in the present embodiment, the fixing temperature of the fixing unit 405 is set to correspond one-to-one to the maximum area of the continuous regions of the pixels whose amount of applied toner is equal to or larger than the predetermined threshold, so that the temperature of the fixing unit 405 is controlled with high accuracy.

In the present embodiment, the network system including the image processing and forming apparatus and its functional blocks and the physical configuration of the image forming apparatus 100 including the fixing unit 405 are the same as those of Embodiment 1. Accordingly, explanations thereof are omitted. Further, processing in which the region information detecting unit 304 detects, as the region information, maximum area of the continuous regions of the pixels whose amount of applied toner is equal to or larger than the predetermined threshold is also the same as that of Embodiment 1. Accordingly, explanations thereof are omitted.

In the present embodiment, the control unit 204 controls the temperature of the fixing unit 405 according to the region information. This processing will be explained below.

FIG. 9 is a table showing a one-to-one relationship between the value of the region information and the temperature for controlling fixing in accordance with the present embodiment. This table shows that in a case where the number of pixels whose amount of applied toner is equal to or larger than the predetermined threshold is one, the temperature of the fixing unit 405 is controlled at 180.000° C. Likewise, the numbers of pixels whose amount of applied toner is equal to or larger than the predetermined threshold each correspond to the controlled temperatures of the fixing unit 405. In a case where the number of pixels whose amount of applied toner is equal to or larger than the predetermined threshold is 3600 or more, the temperature of the fixing unit 405 is controlled at 200.000° C. Further, a one-to-one relationship between the value of the region information and the temperature for controlling fixing shown in FIG. 9 is held in a lookup table (hereinafter referred to as "the LUT") in the image forming apparatus 100.

Figure 10:
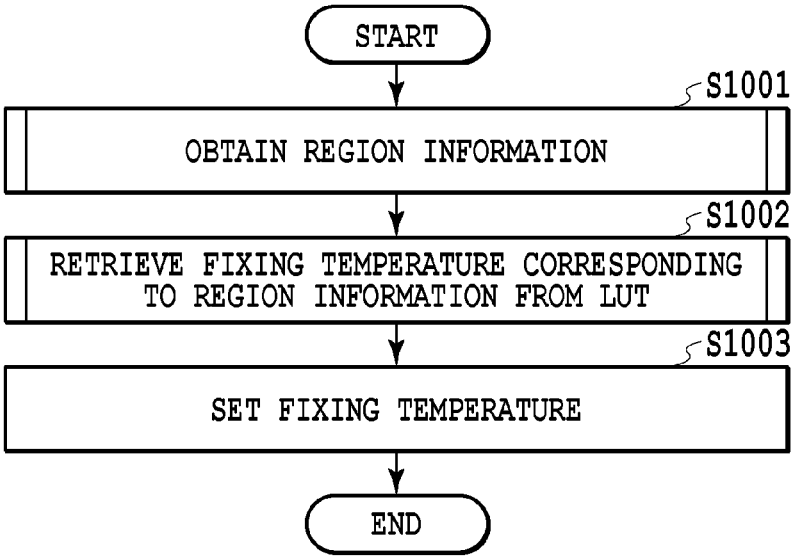
FIG. 10 is a flowchart of fixing temperature control performed by the image forming apparatus in accordance with the embodiment.

FIG. 10 is a flowchart for a case where the control unit 204 controls the temperature of the fixing unit 405 according to the result of detection by the region information detecting unit 304 in accordance with the present embodiment. Further, this flowchart is implemented by the CPU of the image forming apparatus 100 performing processing according to the program stored in the ROM of the image forming apparatus 100.

In step S1001, the control unit 204 of the image forming apparatus 100 obtains the result of detection by the region information detecting unit 304 of the information processing unit 201.

In step S1002, the controlled temperature of the fixing unit 405 corresponding to the obtained region information is retrieved from the LUT in the image forming apparatus 100. Further, information in the LUT is a one-to-one relationship between the value of the region information and the temperature for controlling fixing shown in FIG. 9.

Lastly, in step S1003, the value retrieved in step S1002 is determined as the controlled temperature of the fixing unit 405. The controlled temperature of the fixing unit 405 determined in step S1003 is sent to the control unit 204 of the image forming apparatus 100 and is used to control the temperature of the fixing unit 405.

As described above, in the present embodiment, the controlled temperature of the fixing unit 405 is set to correspond one-to-one to maximum area of the continuous regions of the pixels whose amount of applied toner is equal to or larger than the predetermined threshold, whereby temperature control can be performed with higher precision as compared with Embodiment 1.

Further, the relationship between the fixing temperature and the area of the continuous region of the pixels whose amount of applied toner is equal to or larger than the predetermined threshold in the present embodiment is an example, and the present invention is not limited to this example. The relationship between the area of the continuous region and the fixing temperature is determined according to a material used by the fixing unit 405 of the image forming apparatus 100 and the thermal responsiveness of the fixing unit 405.

(Embodiment 3)

In Embodiment 1, the temperature of the fixing unit 405 is determined discretely according to the result of detection by the region information detecting unit 304 to perform temperature control. In Embodiment 2, the temperature of the fixing unit 405 is determined continuously to perform temperature control. In the above-explained embodiments, the region information detecting unit 304 detects the area of the pixels calculated by using the continuity of the pixels whose amount of applied toner is equal to or larger than the predetermined threshold.

However, even in a case where the total amount of applied toner in a local region of a predetermined size (for example, 80 pixels×80 pixels) in an image is equal to or larger than a certain value, it is considered necessary to change the controlled temperature of the fixing unit 405 in consideration of the thermal responsiveness of the fixing unit 405. This is because in a case where the total amount of applied toner in the local region in the image is large, it is necessary to fix the image at a high temperature, and in a case where the total amount of applied toner in the local region in the image is small, it is possible to fix the image at a low temperature.

Accordingly, in the present embodiment, the region information detecting unit 304 calculates the total amount of applied toner in the local region of the predetermined size in the image and controls the temperature of the fixing unit 405 according to the result of calculation.

In the present embodiment, the network system including the image forming apparatus 100 and its functional blocks and the physical configuration of the image forming apparatus 100 including the fixing unit 405 are the same as those of Embodiments 1 and 2. Accordingly, explanations thereof are omitted.

With respect to the present embodiment, an explanation will be made on processing in which the region information detecting unit 304 detects the total amount of applied toner in the local region as the region information and processing in which the control unit 204 controls the temperature of the fixing unit 405 according to the region information.

Firstly, the total amount of applied toner in the local region which is necessary for explaining the present embodiment will be explained with reference to FIGS. 11A and 11B. The total amount of applied toner is defined in the following manner.

Figure 11A:
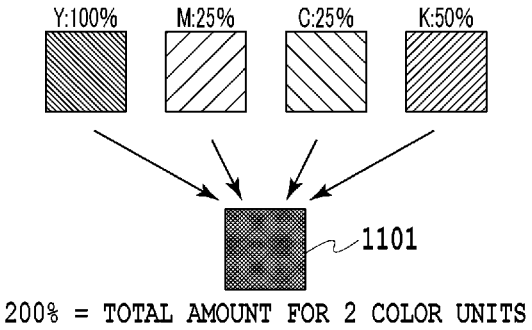
FIG. 11A is an explanatory diagram of the total amount of applied toner in accordance with an embodiment.

For example, assume that a pixel 1101 in FIG. 11A represents a region of one pixel. In a case where toner of Y 100%, M 25%, C 25%, and K 50% is applied on the pixel 1101, toner whose amount is represented by the following formula is applied on the pixel.

$$100\%(Y)+25\%(M)+25\%(C)+50\%(K)=200\%$$

In a case where the amount of applied toner for one color unit is 100%, since toner of 200% is applied on the region of the one pixel (the pixel 1101), toner for two color units is applied, and the total amount of applied toner in the region of the one pixel can be said to be an amount for 2 color units.

Figure 11B:
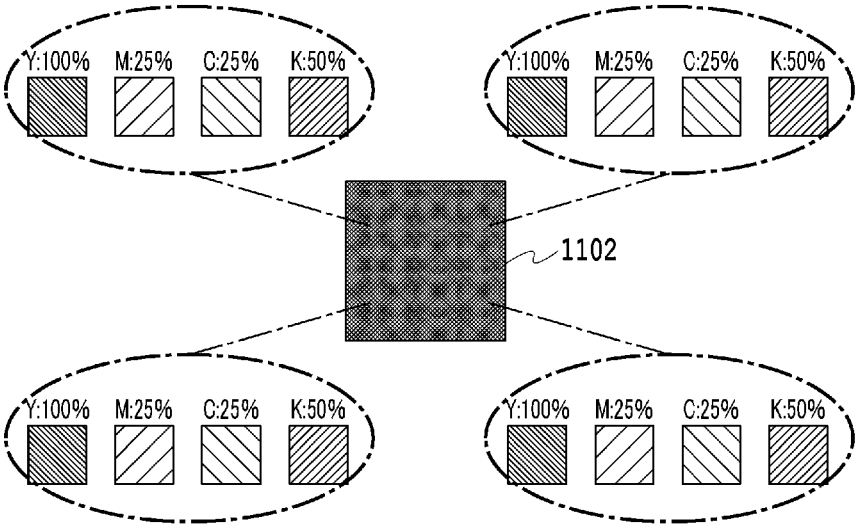
FIG. 11B is an explanatory diagram of the total amount of applied toner in accordance with the embodiment.

According to this definition, in a case where the size of the region is four pixels as represented by a region 1102 of FIG. 11B, and toner of Y 100%, M 25%, C 25%, and K 50% is applied on each pixel, the total amount of applied toner in the region 1102 is an amount for 8 color units (=2 color units×4 pixels).

Next, a relationship between the thermal responsiveness of the fixing unit 405 and the total amount of applied toner is considered by paying attention to the local region of 80 pixels×80 pixels which is used as an example in the present embodiment. In a case where the total amount of applied toner in the local region of 80 pixels×80 pixels exceeds an amount for 7200 color units (=60 pixels×60 pixels×2 color units), the controlled temperature of the fixing unit 405 cannot be lowered. However, in a case where the total amount of applied toner is an amount for 800 color units (=20 pixels×20 pixels×color units), the controlled temperature of the fixing unit 405 can be lowered by 5° C. Further, in a case where the total amount of applied toner is an amount for 200 color units (=10 pixels×10 pixels×2 color units), the controlled temperature of the fixing unit 405 can be lowered by 10° C. In a case where the total amount of applied toner is smaller than the amount for 200 color units, the controlled temperature of the fixing unit 405 can be lowered by 15° C.

Figure 12:
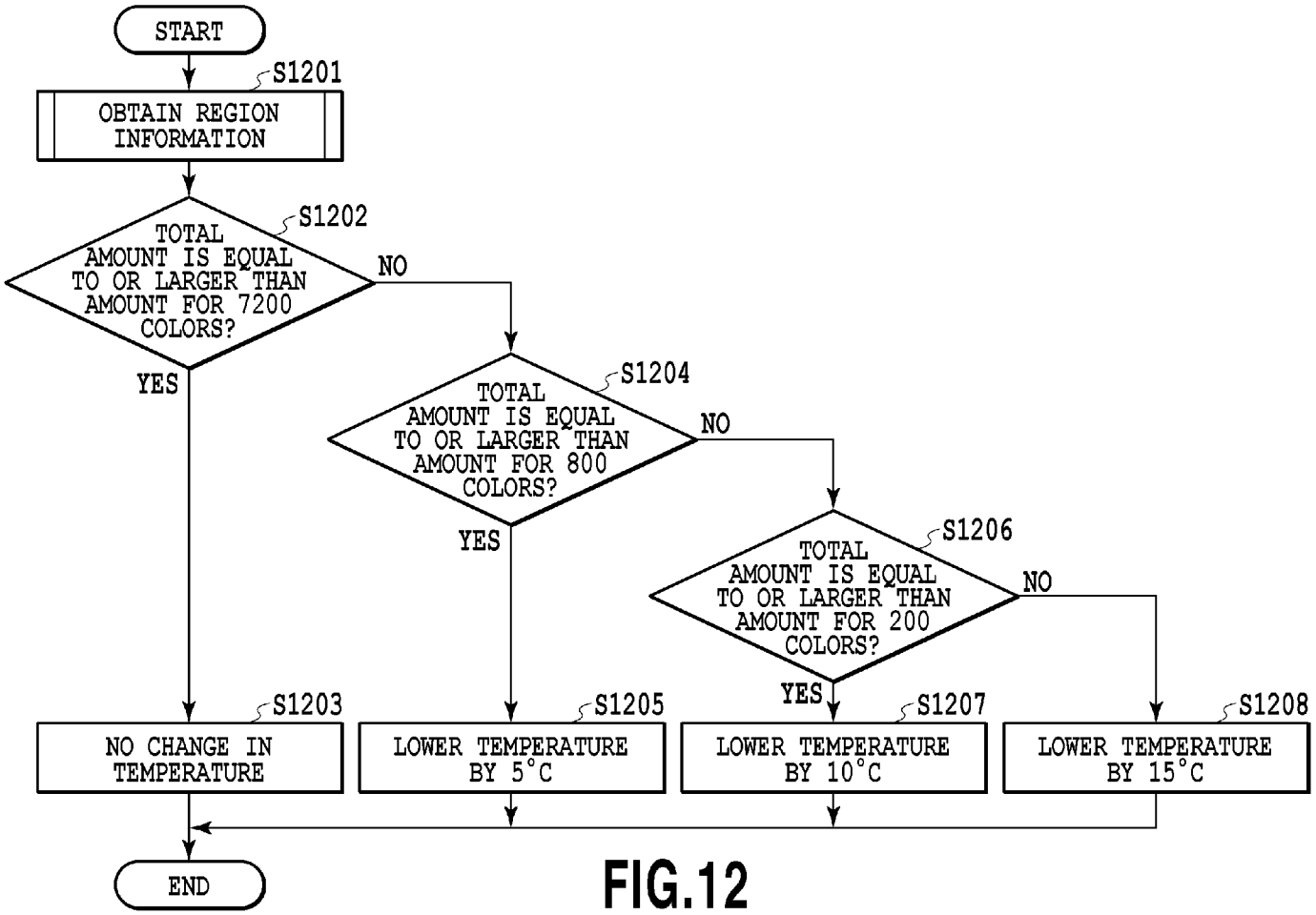
FIG. 12 is a flowchart of fixing temperature control performed by the image forming apparatus in accordance with the embodiment.

In view of the above, a flowchart for controlling the temperature of the fixing unit 405 by the control unit 204 of the image forming apparatus 100 is designed to be the one shown in FIG. 12. Further, this flowchart is implemented by the CPU of the image forming apparatus 100 performing processing according to the program stored in the ROM of the image forming apparatus 100.

In step S1201, the control unit 204 obtains, from the information processing unit 201, the total amount of applied toner as the region information.

Next, in step S1202, it is determined whether or not the total amount of applied toner is equal to or larger than the amount for 7200 color units. In a case where the total amount of applied toner is equal to or larger than the amount for 7200 color units, the process proceeds to step S1203. In a case where the total amount of applied toner is smaller than the amount for 7200 colors, the process proceeds to step S1204.

In step S1203, the controlled temperature of the fixing unit 405 is not changed.

In step S1204, it is determined whether or not the total amount of applied toner is equal to or larger than the amount for 800 color units. In a case where the total amount of applied toner is equal to or larger than the amount for 800 color units, the process proceeds to step S1205. In a case where the total amount of applied toner is smaller than the amount for 800 color units, the process proceeds to step S1206.

In step S1205, the controlled temperature of the fixing unit 405 is lowered by 5° C.

In step S1206, it is determined whether or not the total amount of applied toner is equal to or larger than the amount for 200 color units. In a case where the total amount of applied toner is equal to or larger than the amount for 200 color units, the process proceeds to step S1207. In a case where the total amount of applied toner is smaller than the amount for 200 colors, the process proceeds to step S1208.

In step S1207, the controlled temperature of the fixing unit 405 is lowered by 10° C.

In step S1208, the controlled temperature of the fixing unit 405 is lowered by 15° C.

In this manner, the temperature of the fixing unit 405 is controlled according to the detected total amount of applied toner in the local region.

Figure 13:
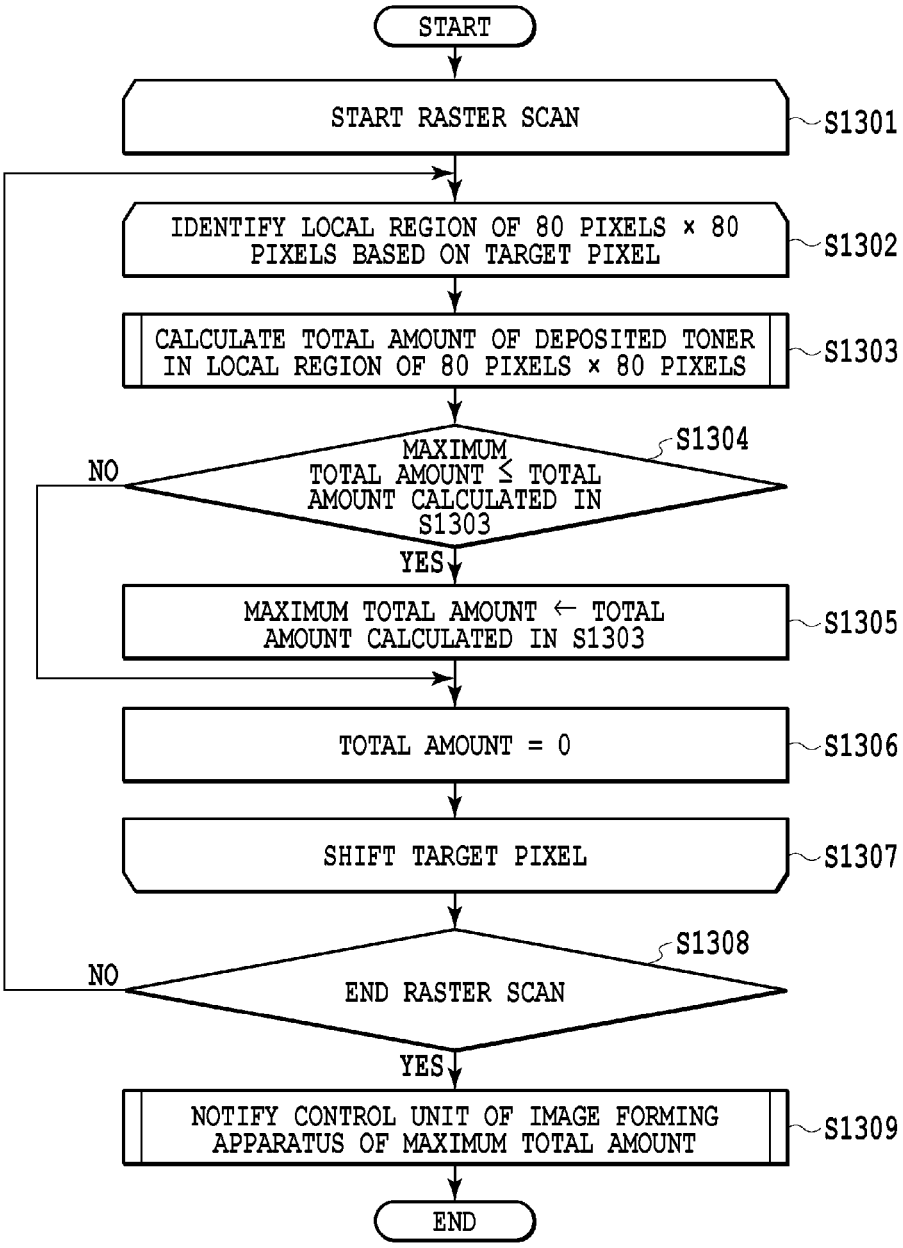
FIG. 13 is a flowchart of region information detection performed by the region information detecting unit in accordance with the embodiment.

As described above, in order to change the controlled temperature of the fixing unit 405 according to the total amount of applied toner in the local region in the image, it is necessary to detect the total amount of applied toner in the local region by the region information detecting unit 304 in the information processing unit 201. The detecting method will be explained below with reference to the flowchart of FIG. 13. Further, this flowchart is implemented by the CPU of the image forming apparatus 100 performing processing according to the program stored in the ROM of the image forming apparatus 100.

In step S1301, raster scan is started.

In step S1302, the local region of 80 pixels×80 pixels is identified based on the target pixel.

Next, in step S1303, the total amount of applied toner in the local region of 80 pixels×80 pixels is calculated by summing the amounts of applied toner for YMCK in the respective pixels of 80 pixels×80 pixels.

In step S1304, the maximum total amount of applied toner is compared with the total amount of applied toner calculated in step S1303. In a case where the total amount of applied toner calculated in step S1303 is larger than the maximum total amount of applied toner, the process proceeds to step S1305. Further, in a case where the total amount of applied toner calculated in step S1303 is smaller than the maximum total amount of applied toner, the process proceeds to step S1306.

In step S1305, the total amount of applied toner calculated in step S1303 is assigned to the maximum total amount of applied toner. In this manner, the total amount of applied toner calculated in step S1303 is held as the maximum total amount of applied toner.

In step S1306, the total amount of applied toner is cleared.

In step S1307, the target pixel is shifted one pixel.

Next, in step S1308, it is determined whether raster scan ends. In a case where it is determined that raster scan does not end, the process proceeds to step S1302. More specifically, steps S1302 to S1307 are repeated until it is determined that raster scan ends in step S1308. Further, in a case where it is determined that raster scan ends, the process proceeds to step S1309.

In step S1309, the information processing unit 201 notifies the control unit 204 of the image forming apparatus 100 of the maximum total amount of applied toner.

In this manner, it becomes possible to obtain and use the total amount of applied toner in the local region in the image to determine the controlled temperature of the fixing unit 405. Further, the size of the local region in the image and the total amount of applied toner in the local region which is necessary for determining the controlled temperature of the fixing unit 405 in the present embodiment are examples and the present invention is not limited to these examples. The size of the local region in the image and the total amount of applied toner in the local region are variable according to a material for the fixing unit 405 and the thermal responsiveness of the fixing unit 405.

Further, it is possible to set a one-to-one relationship between the total amount of applied toner in the local region in the image and the controlled temperature of the fixing unit 405 to continuously perform temperature control as in Embodiment 2.

Further, although as color material toner is applied in the description of Embodiments 1 to 3, it is also possible to apply ink used for ink jet printer.

(Other Embodiments)

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-201526, filed Sep. 13, 2012, and 2013-166513, filed Aug. 9, 2013, which are hereby incorporated by reference herein in their entirety.

What is claimed is:

1. An image forming apparatus for controlling a fixing temperature of a fixing unit configured to fix color material on a printing medium, the image forming apparatus comprising:

an input unit configured to input image data; and a controlling unit configured to control a fixing temperature of the fixing unit based on a size of a continuous region of pixels whose pixel values are equal to or larger than a predetermined pixel value in the image data, wherein the controlling unit controls the fixing temperature such that the fixing temperature is made to be a first fixing temperature in a case where the size of the continuous region is equal to or larger than a predetermined value, and the fixing temperature is made to be a second fixing temperature which is lower than the first fixing temperature in a case where the size of the continuous region is smaller than the predetermined value.

2. The image forming apparatus according to claim 1, wherein the controlling unit controls the fixing temperature such that the larger the size of the continuous region is, the higher the fixing temperature is made to be.

3. The image forming apparatus according claim 1, wherein the controlling unit controls the fixing temperature of the fixing unit, in a case where there is more than one continuous region of pixels whose pixel values are equal to or larger than the predetermined pixel value in the image data, based on a size of a continuous region having maximum region among the continuous regions in the image data.

4. The image forming apparatus according claim 1, wherein the size of the continuous region used by the control unit is the number of pixels in the continuous region.

5. An image forming method for controlling a fixing temperature of a fixing unit configured to fix color material on a printing medium, the image forming method comprising:

inputting image data;

controlling a fixing temperature of the fixing unit based on a size of a continuous region of pixels whose pixel values are equal to or larger than a predetermined pixel value in the image data, wherein the controlling includes controlling the fixing temperature such that the fixing temperature is made to be a first fixing temperature in a case where the size of the continuous region is equal to or larger than a predetermined value, and the fixing temperature is made to be a second fixing temperature which is lower than the first fixing temperature in a case where the size of the continuous region is smaller than the predetermined value.

6. A non-transitory computer-readable medium storing program which causes a computer to perform an image forming method for controlling a fixing temperature of a fixing unit configured to fix color material on a printing medium, the image forming method comprising:

an input step of inputting image data; and a controlling step of controlling a fixing temperature of the fixing unit based on a size of a continuous region of pixels whose pixel values are equal to or larger than a predetermined pixel value in the image data, wherein the controlling includes controlling the fixing temperature such that the fixing temperature is made to be a first fixing temperature in a case where the size of the continuous region is equal to or larger than a predetermined value, and the fixing temperature is made to be a second fixing temperature which is lower than the first fixing temperature in a case where the size of the continuous region is smaller than the predetermined value.

* * * * *